US009022079B2

(12) United States Patent
Py et al.

(10) Patent No.: US 9,022,079 B2
(45) Date of Patent: May 5, 2015

(54) CONTAINER CLOSURE WITH OVERLYING NEEDLE PENETRABLE AND RESEALABLE PORTION AND UNDERLYING PORTION COMPATIBLE WITH FAT CONTAINING LIQUID PRODUCT, AND RELATED METHOD

(75) Inventors: Daniel Py, Larchmont, NY (US); Norbert Assion, Shelton, CT (US); Nathaniel Houle, Hebron, CT (US); Debashis Sahoo, Danbury, CT (US); M. Jeffrey Willey, Brookfield, CT (US); Eric E. Hartman, Ridgefield, CT (US); John Guthy, Southbury, CT (US)

(73) Assignee: MedInstill Development LLC, New Milford, CT (US)

( * ) Notice: Subject to any disclaimer, the term of this patent is extended or adjusted under 35 U.S.C. 154(b) by 0 days.

(21) Appl. No.: 13/419,204

(22) Filed: Mar. 13, 2012

(65) Prior Publication Data

US 2012/0186697 A1 Jul. 26, 2012

Related U.S. Application Data

(60) Continuation of application No. 12/894,224, filed on Sep. 30, 2010, now Pat. No. 8,132,600, which is a division of application No. 11/339,966, filed on Jan. 25, 2006, now Pat. No. 7,954,521.

(60) Provisional application No. 60/647,049, filed on Jan. 25, 2005.

(51) Int. Cl.
*B65B 1/20* (2006.01)
*B65D 51/00* (2006.01)
(Continued)

(52) U.S. Cl.
CPC ..... *B65D 51/002* (2013.01); *B65D 51/18* (2013.01); *B65B 51/22* (2013.01); *B65B 55/025* (2013.01);
(Continued)

(58) Field of Classification Search
USPC ..... 141/2, 11, 69, 85, 89–92, 129, 130, 141/329; 53/425, 426; 250/455.11, 492.1
See application file for complete search history.

(56) References Cited

U.S. PATENT DOCUMENTS 520,014 A 5/1894 Smith
2,364,126 A 12/1941 Cantor et al.
(Continued)

FOREIGN PATENT DOCUMENTS

WO WO 2004076288 A1 * 9/2004 ..... B65B 55/08

OTHER PUBLICATIONS

International Search Report and Written Opinion of the International Searching Authority for International Application No. PCT/US2006/02766, mailed Jul. 18, 2008.

*Primary Examiner* — Timothy L Maust
(74) *Attorney, Agent, or Firm* — McCarter & Englsih, LLP

(57) ABSTRACT

A container and method are provided for storing fat containing liquid products. The container includes a body defining a storage chamber for receiving the product, and a container closure. A first material portion forms at least most of the surface area overlying the storage chamber that can contact any product therein. Neither the body nor the first material portion leach more than a predetermined amount of leachables into the product or undesirably alter a taste profile thereof. A needle penetrable and thermally resealable second material portion either (i) overlies the first material portion and cannot contact any product within the storage chamber, or (ii) forms a substantially lesser surface area overlying the storage chamber that can contact any product therein in comparison to the first material portion. A sealing portion is engageable with the body to form a substantially dry hermetic seal between the container closure and body.

24 Claims, 5 Drawing Sheets

(51) Int. Cl.

| | |
|---|---|
| ***B65D 51/18*** | (2006.01) |
| ***B65B 51/22*** | (2006.01) |
| ***B65B 55/02*** | (2006.01) |
| ***B65B 55/10*** | (2006.01) |
| ***B65B 3/00*** | (2006.01) |
| *B65B 7/28* | (2006.01) |

(52) U.S. Cl.
CPC ..... *B65B 55/10* (2013.01); *B65B 3/003* (2013.01); *B65D 2251/0015* (2013.01); *B65D 2251/0078* (2013.01); *B65B 7/2842* (2013.01)

(56) References Cited

U.S. PATENT DOCUMENTS

| | | | | | |
|---|---|---|---|---|---|
| 3,092,278 | A | | 6/1963 | Jarnhall | |
| 3,425,579 | A | | 2/1969 | Braun et al. | |
| 3,913,772 | A | | 10/1975 | Ochs | |
| 4,230,231 | A | | 10/1980 | Burnett et al. | |
| 4,366,912 | A | | 1/1983 | Matukura et al. | |
| 4,394,923 | A | | 7/1983 | Sugiyama | |
| 4,401,423 | A | | 8/1983 | Bellehache et al. | |
| 4,473,163 | A | | 9/1984 | Geiger | |
| 4,493,427 | A | | 1/1985 | Wolkonsky | |
| 4,635,807 | A | | 1/1987 | Knapp | |
| 4,682,703 | A | | 7/1987 | Kasai et al. | |
| 4,748,735 | A | | 6/1988 | Hayes | |
| 4,790,117 | A | * | 12/1988 | Hansen | 53/410 |
| 4,809,858 | A | | 3/1989 | Ochs | |
| 4,966,294 | A | | 10/1990 | Mack et al. | |
| 5,067,532 | A | * | 11/1991 | Lang et al. | 141/329 |
| 5,129,212 | A | * | 7/1992 | Duffey et al. | 53/426 |
| 5,275,299 | A | | 1/1994 | Konrad et al. | |
| 5,341,949 | A | | 8/1994 | Hayes | |
| 5,641,004 | A | * | 6/1997 | Py | 141/3 |
| 5,804,744 | A | | 9/1998 | Tan et al. | |
| 5,829,608 | A | | 11/1998 | Clerget | |
| 5,919,182 | A | * | 7/1999 | Avallone | 604/411 |
| 5,924,584 | A | | 7/1999 | Hellstrom et al. | |
| 5,964,261 | A | | 10/1999 | Neuenfeldt et al. | |
| 5,975,322 | A | | 11/1999 | Reid | |
| 5,984,124 | A | | 11/1999 | Takano | |
| 6,068,150 | A | | 5/2000 | Mitchell et al. | |
| 6,186,997 | B1 | | 2/2001 | Gabbard et al. | |
| 6,247,604 | B1 | | 6/2001 | Taskis et al. | |
| 6,308,847 | B1 | | 10/2001 | Andersson et al. | |
| 6,604,561 | B2 | | 8/2003 | Py | |
| 6,681,475 | B2 | | 1/2004 | Thibault et al. | |
| 7,168,459 | B2 | * | 1/2007 | Bibbo et al. | 141/5 |
| 7,365,343 | B2 | * | 4/2008 | Thilly et al. | 250/455.11 |
| 7,569,559 | B2 | | 8/2009 | Arnold et al. | |
| 7,749,434 | B2 | * | 7/2010 | Naslund et al. | 422/1 |
| 7,832,078 | B2 | | 11/2010 | Thilly et al. | |
| 7,954,521 | B2 | | 6/2011 | Py et al. | |
| 8,017,074 | B2 | | 9/2011 | Arnold et al. | |
| 8,101,589 | B2 | | 1/2012 | Arnold et al. | |
| 8,425,837 | B2 | | 4/2013 | Carbone et al. | |
| 8,580,086 | B2 | | 11/2013 | Matsuuchi et al. | |
| 8,703,066 | B2 | | 4/2014 | Vaughn et al. | |
| 8,721,984 | B2 | | 5/2014 | Carbone et al. | |
| 8,808,622 | B2 | | 8/2014 | Arnold et al. | |
| 2002/0023409 | A1 | | 2/2002 | Py | |
| 2003/0029828 | A1 | | 2/2003 | Amschlinger et al. | |
| 2003/0052074 | A1 | | 3/2003 | Chang et al. | |
| 2004/0112925 | A1 | | 6/2004 | Py et al. | |
| 2004/0256026 | A1 | | 12/2004 | Py | |
| 2009/0270509 | A1 | | 10/2009 | Arnold et al. | |
| 2010/0166603 | A1 | | 7/2010 | Opie | |
| 2011/0085938 | A1 | | 4/2011 | Carbone et al. | |
| 2011/0318225 | A1 | | 12/2011 | Arnold et al. | |
| 2013/0230430 | A1 | | 9/2013 | Carbone et al. | |
| 2014/0301895 | A1 | | 10/2014 | Opie et al. | |

* cited by examiner

CONTAINER CLOSURE WITH OVERLYING NEEDLE PENETRABLE AND RESEALABLE PORTION AND UNDERLYING PORTION COMPATIBLE WITH FAT CONTAINING LIQUID PRODUCT, AND RELATED METHOD

CROSS-REFERENCE TO RELATED APPLICATIONS

This patent application is a continuation of U.S. patent application Ser. No. 12/894,224, filed Sep. 30, 2010, now U.S. Pat. No. 8,132,600, which is a divisional of U.S. patent application Ser. No. 11/339,966, filed Jan. 25, 2006, now U.S. Pat. No. 7,954,521 and claims priority to U.S. Provisional Patent Application No. 60/647,049, filed Jan. 25, 2005, entitled "CONTAINER WITH NEEDLE PENETRABLE AND THERMALLY RESEALABLE STOPPER, SNAP-RING, AND CAP FOR SECURING STOPPER AND SNAP-RING TO CONTAINER AND REMOVING SAME THEREFROM," which are hereby expressly incorporated by reference in its entirety as part of the present disclosure.

FIELD OF THE INVENTION

The present invention relates to containers having container bodies and stoppers for sealing openings in the container bodies, such as containers having polymeric stoppers that are needle penetrable for filling the closed bodies with liquids, such as fat containing liquid nutrition products, and that are laser resealable for laser resealing the needle penetrated region of the stopper.

BACKGROUND OF THE INVENTION

Prior art needle penetrable and laser resealable containers include thermoplastic elastomer ("TPE") stoppers or portions of stoppers that are needle penetrable to needle fill the containers with a product, and are thermally resealable at the resulting needle holes by applying laser radiation thereto to hermetically seal the product within the containers. One of the drawbacks of such TPE stoppers is that they can be difficult to use with fat containing liquid products, such as infant or baby formulas, or other milk-based or low acid products. For example, many such TPE materials contain leachables that can leach into the fat containing product, or otherwise can undesirably alter a taste profile of the product.

Conventional containers and systems for aseptically filling containers with fat containing liquid products, such as infant or baby formulas, or other milk-based or low acid products, employ a container having an open mouth and a screw cap or other type of cap that is secured to the open mouth after aseptically filling the container with the product. In many such systems, the open containers are pre-sterilized by flushing the interior and exterior surfaces of the open containers with a fluid sterilant, such as peroxide vapor or vaporized hydrogen peroxide, to sterilize the food contacting surfaces. Then, the containers are flushed with heated sterile air in order to re-vaporize any fluid sterilant that condenses on the container surfaces and to flush away the sterilant. After flushing with heated sterile air, the open containers are filled through the open mouths of the containers with the desired product, and after filling, the containers are capped to seal the product within the containers. Typically, the sterilizing, flushing, filling and capping processes are all performed within the same sterile zone of the filling system.

One of the drawbacks of this type of filling system is that it can be difficult to remove all of the fluid sterilant from the interior surfaces of the containers, thus leaving sterilant residue, such as hydrogen peroxide, within the containers and thereby contaminating the product filled into the containers. If the level of residue is sufficiently high, the product must be discarded. Alternatively, the sterilant residue can negatively affect the taste or taste profile of the product.

Another drawback of such prior art systems is that because the sterilizing, flushing, filling and capping processes are all performed within the same sterile zone, the apparatus forming the sterile zone tends to be relatively large and complex. Moreover, because the product is open filled (i.e., poured into the open mouths of the containers), the product is not as well contained within the sterile zone as otherwise desired, thus creating hygiene problems within the sterile zone. Such apparatus can require cleaning more frequently than desired due, for example, to the collection of sterilant and/or product residue within the sterile zone. Cleaning such large and complex apparatus can result in substantial down time and expense. As a result, such prior art systems can have undesirably short run times between cleaning and sterilization of the sterile zone. Yet another drawback of such systems is that because they sterilize the packaging, fill and seal apparatus all within the same enclosure and sterile zone, if any part of the system goes down, the entire system must be subjected to clean in place ("CIP") and sterilize in place ("SIP") procedures prior to re-starting, which can further contribute to substantial down time and expense.

Yet another drawback of such prior art systems is that the containers are filled immediately prior to capping resulting in poor closure seals due to the presence of wet product at the sealing surfaces or interfaces.

Another drawback of such prior art systems is that in many cases product must be sterilized after filling by employing a retort process that can undesirably alter the taste of the product.

Accordingly, it is an object of the present invention to overcome one or more of the above-described drawbacks and disadvantages of the prior art.

SUMMARY OF THE INVENTION

In accordance with a first aspect, the present invention is directed to a container for storing a fat containing liquid product. The container is penetrable by a needle for aseptically filling a storage chamber of the container through the needle with the fat containing liquid product, and the resulting needle hole is thermally resealable to seal the fat containing liquid product within the container. The container comprises a body defining a storage chamber therein for receiving the fat containing liquid product and a first aperture in fluid communication with the storage chamber. The body does not leach more than a predetermined amount of leachables into the fat containing liquid product and does not undesirably alter a taste profile of the fat containing liquid product. A container closure assembly of the container includes a stopper receivable within the first aperture for hermetically sealing the storage chamber. The stopper includes a first material portion defining an internal surface in fluid communication with the storage chamber forming at least most of the surface area of the container closure that can contact any fat containing liquid product within the storage chamber. The first material portion does not leach more than a predetermined amount of leachables into the fat containing liquid product or undesirably alter a taste profile of the fat containing liquid product. The predetermined amount of leachables is less than about 100 parts per million ("PPM"), is preferably less than or equal to about 50 PPM, and most preferably is less than or equal to about 10 PPM. A second material portion of the stopper either (i) overlies the first material portion and cannot contact any fat containing liquid product within the storage chamber, or (ii) forms a substantially lesser surface area of the container closure that can contact any fat containing liquid product within the storage chamber in comparison to the first material portion. The second material portion is needle penetrable for aseptically filling the storage chamber with the fat containing liquid product, and a resulting needle aperture formed in the second material portion is thermally resealable to seal the fat containing liquid product within the storage chamber. A sealing portion of the container closure assembly is engageable with the body prior to aseptically filling the storage chamber with the fat containing liquid product to thereby form a substantially dry hermetic seal between the container closure and body. A securing member or cap is connectable between the stopper and body for securing the stopper to the body.

In one embodiment of the present invention, the first material portion is selected from the group including (i) a low mineral oil or mineral oil free thermoplastic; (ii) a low mineral oil or mineral oil free thermoplastic defining a predetermined durometer; (iii) a liquid injection moldable silicone; and (iv) a silicone. The predetermined durometer is within the range of about 20 Shore A to about 50 Shore A, and preferably is within the range of about 25 Shore A to about 35 Shore A.

In one embodiment of the present invention, the second material portion is a thermoplastic elastomer that is heat resealable to hermetically seal the needle aperture by applying laser radiation at a predetermined wavelength and power thereto. The second material portion defines (i) a predetermined wall thickness, (ii) a predetermined color and opacity that substantially absorbs the laser radiation at the predetermined wavelength and substantially prevents the passage of the radiation through the predetermined wall thickness thereof, and (iii) a predetermined color and opacity that causes the laser radiation at the predetermined wavelength and power to hermetically seal the needle aperture formed in the needle penetration region thereof in a predetermined time period of less than or equal to about 5 seconds and substantially without burning the needle penetration region.

In one embodiment of the invention, the second material portion is a thermoplastic elastomer that is heat resealable to hermetically seal the needle aperture by applying laser radiation at a predetermined wavelength and power thereto. The second material portion includes (i) a styrene block copolymer; (ii) an olefin; (iii) a predetermined amount of pigment that allows the second material portion to substantially absorb laser radiation at the predetermined wavelength and substantially prevent the passage of radiation through the predetermined wall thickness thereof, and hermetically seal the needle aperture formed in the needle penetration region thereof in a predetermined time period of less than or equal to about 5 seconds; and (iv) a predetermined amount of lubricant that reduces friction forces at an interface of the needle and second material portion during needle penetration thereof.

In one embodiment of the invention, the second material portion is a thermoplastic elastomer that is heat resealable to hermetically seal the needle aperture by applying laser radiation at a predetermined wavelength and power thereto. The second material portion includes (i) a first polymeric material in an amount within the range of about 80% to about 97% by weight and defining a first elongation; (ii) a second polymeric material in an amount within the range of about 3% to about 20% by weight and defining a second elongation that is less than the first elongation of the first polymeric material; (iii) a pigment in an amount that allows the second material portion to substantially absorb laser radiation at the predetermined wavelength and substantially prevent the passage of radiation through the predetermined wall thickness thereof, and hermetically seal a needle aperture formed in the needle penetration region thereof in a predetermined time period of less than or equal to about 5 seconds; and (iv) a lubricant in an amount that reduces friction forces at an interface of the needle and second material portion during needle penetration thereof.

In one embodiment of the invention, the first material portion defines a second aperture, the second material portion overlies the second aperture, and the second aperture constitutes less than about 15% of the surface area of the first material portion exposed to the storage chamber. In one such embodiment, the second aperture constitutes less than about 10% of the surface area of the first material portion exposed to the storage chamber. In another embodiment of the present invention, the first material portion is interposed entirely between the second material portion and any fat containing liquid product stored within the storage chamber to thereby prevent contact between the second material portion and fat containing liquid product during storage thereof in the container. In one embodiment of the invention, the first material portion is co-molded with the second material portion. In one such embodiment, either the first material portion or the second material portion is over-molded to the other. In one embodiment of the invention, the second material portion defines a relatively raised portion, and at least one of the first and second material portions defines a relatively recessed portion spaced laterally relative to the relatively raised portion. The relatively raised configuration inherently laterally compresses the needle penetration region to facilitate resealing thereof. In one such embodiment, the relatively raised portion is substantially dome shaped.

In one embodiment of the invention, the securing member is a cap movable between a first position engaging the body and securing the stopper to the body, and a second position spaced away from the body and engaged with the stopper for removing the container closure from the body. Also in a currently preferred embodiment, the first material portion defines a peripheral flange that is releasably connectable to the body. In one such embodiment, the peripheral flange includes a plurality of peripheral flange portions angularly spaced relative to each other. Preferably, either the peripheral flange or the body defines a raised securing surface, and the other defines a corresponding recessed securing surface engageable with the raised surface for securing the peripheral flange and the body to each other. In one embodiment of the invention, the stopper is snap fit to the body, and the securing member or cap is threadedly engageable with the body.

In accordance with another aspect, the present invention is directed to a method for aseptically needle filling and laser resealing a container with a fat containing liquid product. The method comprises the following steps:

(i) providing a container including a body defining a sterile storage chamber therein for receiving the fat containing liquid product and a first aperture in fluid communication with the storage chamber, wherein the body does not leach more than a predetermined amount of leachables into the fat containing liquid product and does not undesirably alter a taste profile of the fat containing liquid product; and a container closure assembly including a stopper receivable within the first aperture for hermetically sealing the storage chamber, wherein the stopper includes a first material portion defining an internal surface in fluid communication with the storage chamber forming at least most of the surface area of the container closure that can contact any fat containing liquid product within the storage chamber and that does not leach more than a predetermined amount of leachables into the fat containing liquid product or undesirably alter a taste profile of the fat containing liquid product, and a second material portion that either (a) overlies the first material portion and cannot contact any fat containing liquid product within the storage chamber, or (b) forms a substantially lesser surface area of the container closure that can contact any fat containing liquid product within the storage chamber in comparison to the first material portion. The predetermined amount of leachables is less than about 100 PPM, is preferably less than or equal to about 50 PPM, and most preferably is less than or equal to about 10 PPM. The second material portion is needle penetrable for aseptically filling the storage chamber with the fat containing liquid product, and a resulting needle aperture formed in the second material portion is thermally resealable to seal the fat containing liquid product within the storage chamber;

(ii) mounting the sealed, empty container defining a sterile storage chamber on a conveyor, and moving the conveyor through a sterile zone;

(iii) transmitting within the sterile zone a fluid sterilant onto at least an exposed portion of the stopper of the container and, in turn, sterilizing with the fluid sterilant at least the exposed portion of the stopper of the container;

(iv) transmitting within the sterile zone a heated gas onto the portion of the container exposed to the fluid sterilant, flushing away with the heated gas the fluid sterilant from at least the exposed portion of the stopper of the container and, in turn, forming a needle penetration region of the stopper substantially free of fluid sterilant;

(v) penetrating the needle penetration region of the stopper with a filling needle coupled in fluid communication with a source of the fat containing liquid product, and introducing fat containing liquid product through the needle and into the storage chamber;

(vi) withdrawing the filling needle from the stopper; and (vii) applying laser radiation to a resulting needle hole in the stopper to thermally reseal the second material portion and, in turn, hermetically seal the fat containing liquid product within the storage chamber.

In one embodiment of the present invention, the method further comprises moving the filled container outside of the sterile zone, and applying outside of the sterile zone a cap to the container that overlies at least an exposed portion of the stopper of the container. The method also preferably further comprises directing an over pressure of sterile gas within the sterile zone, and directing at least a portion of the sterile gas in a flow direction generally from an outlet end toward an inlet end of the sterile zone to, in turn, prevent fluid sterilant from contacting a container during needle filling thereof.

One advantage of the present invention is that the needle penetrable and laser resealable portion of the stopper defined by the second material portion is isolated, or substantially isolated from the fat containing liquid product by the first material portion that does not leach into (or leaches less than a predetermined amount), or undesirably affect the taste profile of the product. As a result, the containers of the present invention can be needle filled and laser resealed without the above-described problems encountered using prior art needle penetrable and laser resealable stoppers formed in whole or in part with TPE or other materials that contain leachables when used in connection with fat containing liquid products.

Yet another advantage of the present invention is that the stopper is sealed to the container body prior to filling the container, thereby forming a dry seal between the stopper and body and avoiding the seal integrity problems encountered with "wet" seals in the prior art.

Another advantage of the present invention is that because the fat containing liquid product is needle filled through a stopper into a sealed, empty, sterile container, there is significantly better product containment within the sterile zone in comparison to the above-described liquid food filling systems, thus requiring less frequent cleaning of the sterile zone and enabling longer run times between cleaning and sterilization of the sterile zone than encountered in such prior art.

Yet another advantage of the present invention is that container sterilization is de-linked from container filling since the interior of the sealed, empty container is sterilized prior to introducing the container into the sterile zone for filling. As a result, the closed containers do not require the post-filling assembly required with prior art liquid food containers and systems, thus enabling the filling apparatus to be significantly smaller, less complex, and more efficient. In addition, the sealed containers can be manufactured off-site from the filling apparatus to thereby avoid problems associated with space constraints in manufacturing and filling facilities.

Another advantage of the present invention is that the product can be aseptically filled into sealed, empty sterile containers, thus avoiding the need to sterilize the product by retort after filling and the negative effects of retort on the filled product.

Other advantages of the present invention and/or of the currently preferred embodiments thereof will become more readily apparent in view of the following detailed description of the currently preferred embodiments and accompanying drawings.

DETAILED DESCRIPTION OF EMBODIMENTS OF THE INVENTION

Figure 1C:
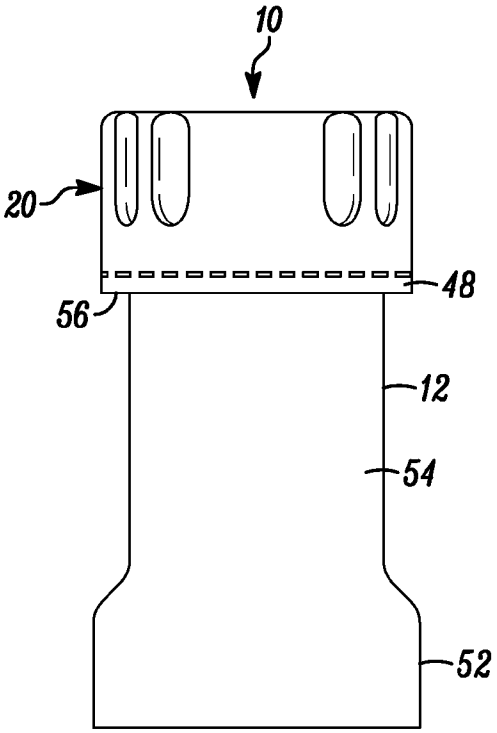
FIGS. 1A, 1B, and 1C are a series of side elevational views of a container embodying the present invention illustrating respectively (i) the container body itself, (ii) the container body with the stopper snap-fit thereto, and (iii) the container body with the stopper and securing member threadedly engaged to the body.

In FIGS. 1A, 1B, 1C and 2, a container embodying the present invention is indicated generally by the reference numeral 10. The container 10 comprises a body 12 defining a storage chamber 14 therein for receiving a substance, such as a fat containing liquid product, and a first aperture 16 in fluid communication with the storage chamber 14. A container closure 15 includes a stopper 18 receivable within the first aperture 16 for hermetically sealing the storage chamber 14 with respect to the ambient atmosphere, and a securing member or cap 20 for securing the stopper to the body. As described further below, the stopper 18 includes a first material portion 22 and a second material portion 24. The first material portion 22 is connectable between the stopper 18 and body 12 for securing the stopper to the body, and in the illustrated embodiment, defines a second aperture 25 for exposing a predetermined portion of the second material portion 24 therethrough. As can be seen, the first material portion 22 defines an internal surface in fluid communication with the storage chamber 14 forming at least most of the surface area of the container closure 15 that can contact any fat containing liquid product within the storage chamber and that does not leach more than a predetermined amount of leachables into the fat containing liquid product or undesirably alter a taste profile of the fat containing liquid product. The fat containing liquid product may be any of numerous different products that are currently known, or that later become known, including without limitation infant or baby formulas, growing-up milks, milks, creams, half-and-halfs, yogurts, ice creams, juices, syrups, condiments, milk-based or milk-containing products, liquid nutrition products, liquid health care products, and pharmaceutical products. The term "leachable" is used herein to mean any chemical compound (volatile or non-volatile) that leaches into the product within the container from a component of the container during the period of storage through expiry of the product. An exemplary leachable to be avoided in connection with fat containing liquid nutrition products, such as infant or baby formulas, is mineral oil. Accordingly, as indicated below, in the exemplary embodiments of the present invention, the first material portion 22 does not contain mineral oil, or contains sufficiently low amounts of mineral oil such that it does not leach mineral oil into the fat containing liquid nutrition product, or substantially does not leach mineral oil into the fat containing liquid nutrition product (i.e., if any mineral oil is leached into the product, any such amount is below the maximum amount permitted under applicable regulatory guidelines for the respective product, such as FDA or LFCA guidelines). In accordance with the present invention, the second material portion 22 and the body 12 each do not leach more than a predetermined amount of leachables into the product. The predetermined amount of leachables is less than about 100 PPM, is preferably less than or equal to about 50 PPM, and most preferably is less than or equal to about 10 PPM.

The second material portion 24 either (i) overlies at least a portion of the first material portion 22, or (ii) forms a substantially lesser surface area, if any, of the container closure 15 that can contact any fat containing liquid product within the storage chamber 14 in comparison to the first material portion 22. In addition, the second material portion 24 is needle penetrable for aseptically filling the storage chamber 14 with the fat containing liquid product, and a resulting needle hole formed in the second material portion 24 after withdrawing the needle is thermally resealable to seal the fat containing liquid product within the storage chamber. As shown typically in FIG. 2, the second material portion 22 of the stopper defines an annular groove 27 formed in a peripheral flange portion thereof, and the end portion of the container body 12 is received therein to form a substantially hermetic seal between the stopper and body.

One advantage of the present invention is that the stopper 18 is sealed to the body 12 prior to filling the storage chamber 14 with the product, and therefore a dry seal is formed between the stopper and body. As a result, the containers of the present invention can provide significantly higher seal integrity in comparison to prior art containers in which the cap is sealed after filling the container thus giving rise to a significantly higher likelihood of forming a less reliable "wet" seal. Yet another advantage of the illustrated embodiment of the invention is that the stopper 18 is assembled and sealed to the body 12 by inserting or pressing the stopper into the mouth or opening 16 of the body. Accordingly, the rotational or screwing motions encountered in prior art containers are avoided within the sterile zone, thus simplifying the assembly process within the sterile zone, and thereby enabling an increased level of sterility assurance and reduced complexity within the sterile zone in comparison to prior art containers wherein the seals are created by screwing a cap onto a container body. If desired, however, the stoppers can be threadedly or rotatably attached and/or the caps can be applied to the containers within the sterile zone if for some reason this is desired or otherwise required.

The securing member or cap 20 is movable between a first position engaging the body 12 and securing the stopper 18 to the body, and a second position spaced away from the body 12 for exposing the second aperture 16 and allowing access to the substance within the storage chamber 14. In the first position, the cap 20 is engaged with the stopper 18 for removing the assembled container closure from the body. In the embodiment of the present invention wherein the product stored within the container is a fat containing liquid nutrition product, such as a baby or infant formula, a nipple (not shown) of a type known to those of ordinary skill in the pertinent art may be threadedly attached to the threads 44 or otherwise attached to the body 12 to allow a baby or child to drink the product within the storage chamber through the nipple.

Figure 2:
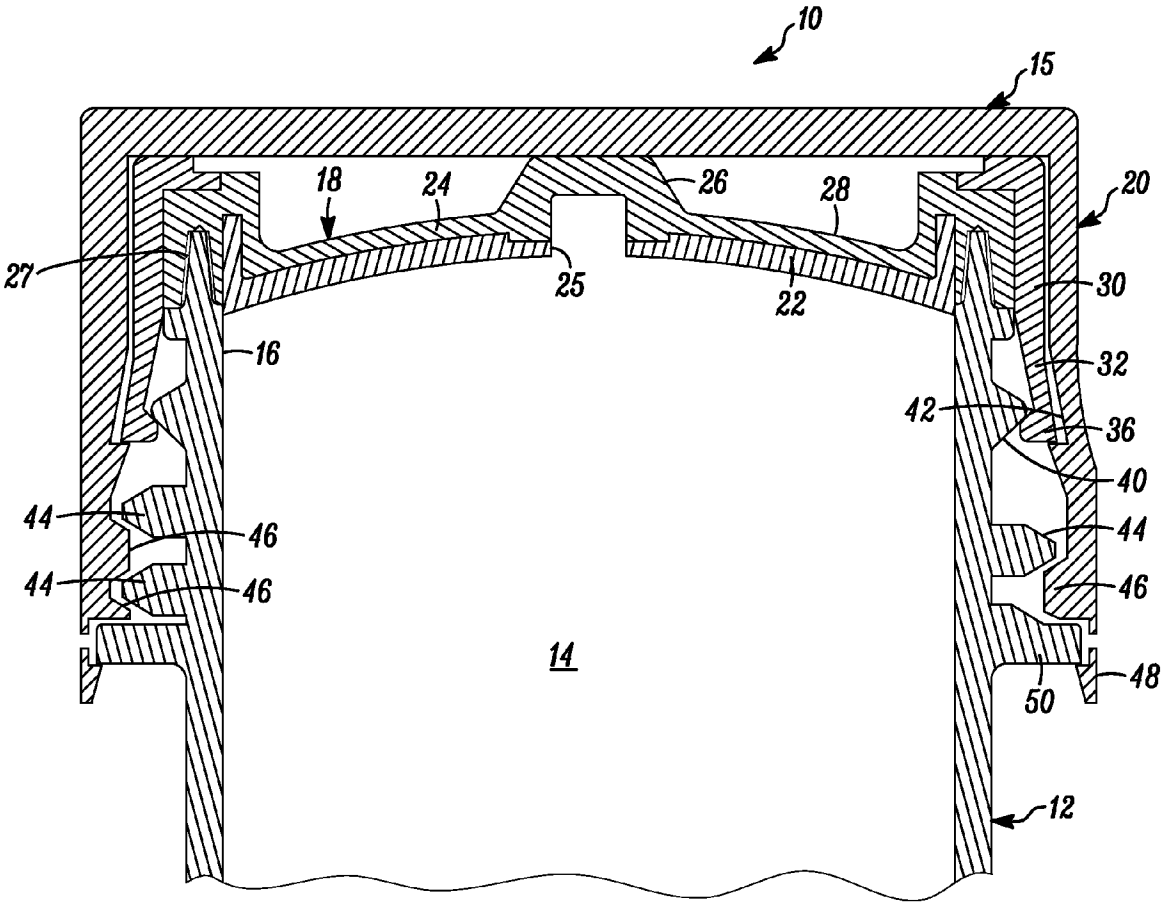
FIG. 2 is a partial, cross-sectional view of the assembled container of FIGS. 1A, 1B and 1C.

As shown typically in FIG. 2, the second material portion 24 is superimposed over the first material portion 22. In the illustrated embodiment, the first material portion 22 and second material portion 24 are co-molded, such as by overmolding the second material portion to the first material portion, or vice-versa. However, as may be recognized by those of ordinary skill in the pertinent art based on the teachings herein, the first and second material portions may be thermally fused or otherwise assembled in any of numerous different ways that are current known, or that later become known. Although in the illustrated embodiment a small portion of the second material portion 24 is exposed to the storage chamber 14, if desired, the first material portion 22 may completely underlie the second material portion 24 and/or otherwise fully isolate the second material portion from the storage chamber 14 and product stored therein.

As also shown typically in FIG. 2, the second material portion 24 defines a relatively raised portion 26 overlying the second aperture 25 of the first material portion 22, and a relatively recessed portion 28 spaced laterally relative to, and surrounding the relatively raised portion. The raised portion 26 defines the needle penetration and thermally resealable region of the second material portion 24. In the illustrated embodiment, the relatively raised portion is substantially dome shaped. One advantage of forming the needle penetrable and thermally resealable portion 26 in a relatively raised configuration, such as a dome shape, is that the septum material (i.e., the needle penetrable and thermally resealable portion) is maintained in compression, and thus is substantially self-resealing. Accordingly, when the filling needle (not shown) is removed, the septum compresses itself about the resulting needle hole, thus closing or substantially closing the needle hole. As a result, when thermally resealed, such as by the application of laser or light energy thereto, a high integrity seal may be obtained. If, on the other hand, the septum material is in tension, such as may occur if the septum material is attached about its periphery to the first material portion, it may prevent thermal resealing of the resulting needle hole and/or may prevent the formation of a high integrity seal. If desired, a device (not shown) can be employed to place the needle penetration region of the stopper in compression during needle filling thereof. As may be recognized by those of ordinary skill in the pertinent art based on the teachings herein, although there can be significant advantages derived from the illustrated septum configuration, or otherwise from placing the needle penetration region of the septum into compression to facilitate resealing thereof, these and other aspects of the stopper may take any of numerous different shapes and/or configurations that are currently known, or that later become known.

The first material portion 22 defines a peripheral flange 30 that is releasably connectable to the body 12. In the illustrated embodiment, and as shown typically in FIG. 1, the peripheral flange 30 includes a plurality of peripheral flange portions 32 angularly spaced relative to each other with angularly-extending gaps 34 formed therebetween. As a result, the peripheral flange portions 32 are radially flexible to facilitate forming a snap-fit connection between the peripheral flange and the body. As shown typically in FIG. 2, each peripheral flange portion 32 defines an angularly-extending raised securing surface 36, and the body 12 defines a corresponding angularly-extending recessed securing surface 40 that is engageable with the raised surface 36 for securing the peripheral flange and body to each other. In the illustrated embodiment, the peripheral flange 30 is snap fit to the body 12. However, as may be recognized by those of ordinary skill in the pertinent art based on the teachings herein, other connecting mechanisms or structures that are currently known, or that later become known, equally may be used. As also shown typically in FIG. 2, the securing member or cap 20 defines an annular recess 42 for receiving therein the exterior edges of the peripheral flange portions 32 to thereby interlock the first material portion 22 and cap 20 to each other when the cap is moved into the second or closed position. The body 12 defines first threads 44 and the securing member or cap 20 defines second threads 46 that threadedly engage each other to secure the cap to the body.

As can be seen, the second material portion 24 overlies the first material portion 22, and the first material portion substantially isolates the second material portion relative to the storage chamber 14 and thus relative to the product contained within the storage chamber. Preferably, substantially the only portion of the second material portion 24, if any, exposed to the storage chamber 14 (or the product contained therein) is the portion 26 overlying the second aperture 25. In the illustrated embodiment, the second aperture 25 preferably constitutes less than about 15% of the surface area of the first material portion 22 exposed to the storage chamber 14 or product contained therein, and most preferably constitutes less than about 10% of the surface area of the first material portion 22 exposed to the storage chamber or product contained therein. As indicated above, if desired, the first material portion 22 may completely underlie the second material portion 24 to thereby eliminate the second aperture 25 and/or otherwise fully isolate the second material portion from the storage chamber 14 and/or product stored therein.

As can be seen, the securing member or cap 20 includes a frangible portion 48 that is snap-fit and thereby interlocked with a peripheral flange 50 formed on the body 12, and that frangibly connects the cap to the body to thereby provide a tamper-evident or tamper-proof closure.

As indicated above, the second material portion 24 is preferably co-molded with the first material portion 22, such as by over-molding the second material portion to the first material portion. In addition, the stopper 18 may be molded in the same mold as the container body 12, and at least one of the stopper and the body may be assembled within or adjacent to the mold in accordance with the teachings of commonly-assigned U.S. patent application Ser. Nos. 11/074,454 and 11/074,513 incorporated by reference below, and U.S. Provisional Patent Application Ser. No. 60/727,899 filed Oct. 17, 2005, entitled "Sterile De-Molding Apparatus And Method," which is hereby expressly incorporated by reference as part of the present disclosure.

In addition, the sterile, empty stopper and body assemblies are needle filled and thermally resealed in accordance with the teachings of any of the following patent applications and patents that are hereby incorporated by reference in their entireties as part of the present disclosure: U.S. patent application Ser. No. 10/766,172 filed Jan. 28, 2004, entitled "Medicament Vial Having A Heat-Sealable Cap, And Apparatus and Method For Filling The Vial," which is a continuation-in-part of similarly titled U.S. patent application Ser. No. 10/694,364, filed Oct. 27, 2003, which is a continuation of similarly titled co-pending U.S. patent application Ser. No. 10/393,966, filed Mar. 21, 2003, which is a divisional of similarly titled U.S. patent application Ser. No. 09/781,846, filed Feb. 12, 2001, now U.S. Pat. No. 6,604,561, issued Aug. 12, 2003, which, in turn, claims the benefit of similarly titled U.S. Provisional Application Ser. No. 60/182,139, filed Feb. 11, 2000; similarly titled U.S. Provisional Patent Application No. 60/443,526, filed Jan. 28, 2003; similarly titled U.S. Provisional Patent Application No. 60/484,204, filed Jun. 30, 2003; U.S. patent application Ser. No. 10/655,455, filed Sep. 3, 2003, entitled "Sealed Containers And Methods Of Making And Filling Same;" U.S. patent application Ser. No. 10/983,178 filed Nov. 5, 2004, entitled "Adjustable Needle Filling and Laser Sealing Apparatus and Method;" U.S. patent application Ser. No. 11/070,440 filed Mar. 2, 2005, entitled "Apparatus and Method for Needle Filling and Laser Resealing;" U.S. patent application Ser. No. 11/074,513 filed Mar. 7, 2005, entitled "Apparatus for Molding and Assembling Containers with Stoppers and Filling Same;" and U.S. patent application Ser. No. 11/074,454 filed Mar. 7, 2005, entitled "Method for Molding and Assembling Containers with Stoppers and Filling Same."

Figure 3A:
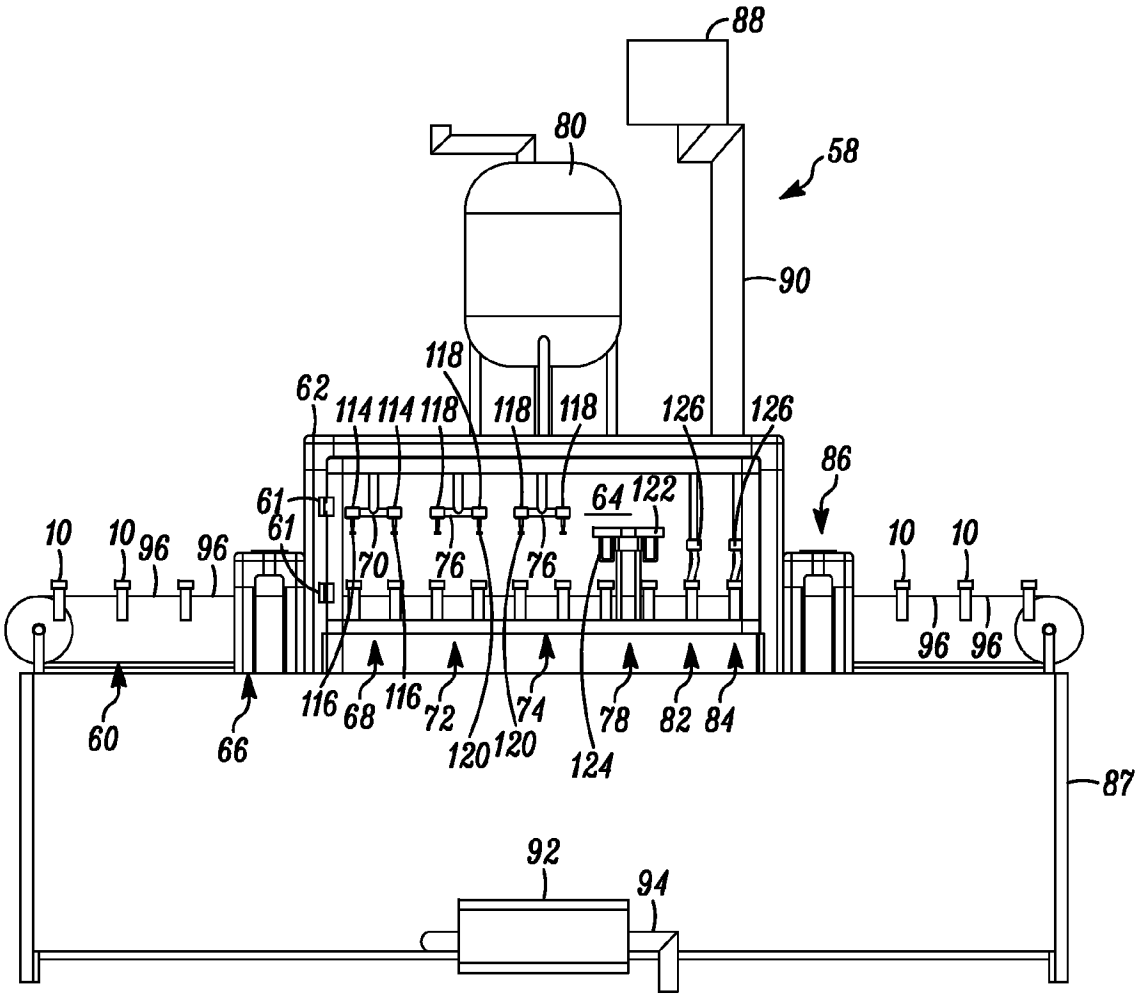
FIG. 3A is a side elevational view of an apparatus embodying the present invention for needle filling and laser resealing the containers of FIGS. 1A, 1B, 1C and 2.
Figure 3B:
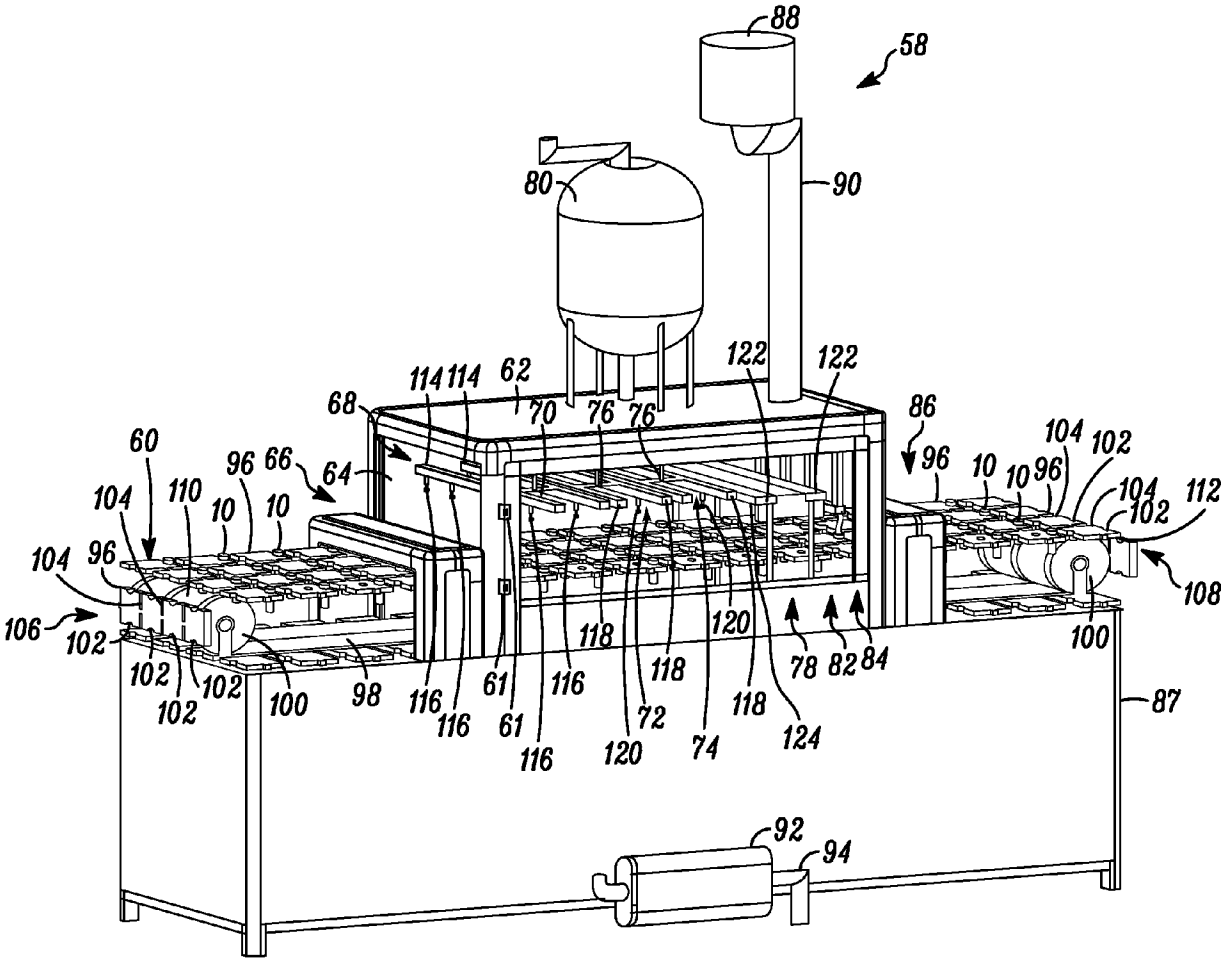
FIG. 3B is a perspective view of the apparatus of FIG. 3A.

In FIGS. 3A and 3B, an exemplary needle filling and laser resealing apparatus for use in filling and resealing the containers of the present invention is indicated generally by the reference numeral 58. The apparatus 58 includes a closed loop or endless conveyor 60 for indexing and thereby conveying the containers 10 through the apparatus. The containers 10 that are fed by the conveyor 60 into the apparatus 58 include the stoppers 18 sealed to the openings 16 of the bodies 12, but do not include the caps 20 (FIG. 2). The interior chamber 14 of each container is sterile, such as by assembling the stoppers and containers in the mold and/or within a sterile zone within or adjacent to the mold as described in any of the co-pending patent applications incorporated by reference above, by transmitting radiation, such as gamma or ebeam radiation, onto the sealed, empty stopper and body assembly, or by employing a fluid sterilant, such as vaporized hydrogen peroxide. The apparatus 58 includes an elongated housing 62 defining within it a sterile zone 64 and through which the conveyor 60 with the containers 10 located thereon passes. The term "sterile zone" is used herein within the meaning of the applicable regulatory guidelines as promulgated, for example, by the FDA (the United States Food and Drug Administration) or other national or applicable regulatory agency, and including applicable Low Acid Canned Food ("LACF") regulations, and is preferably defined by a commercially sterile area that is maintained sterile by means of an over pressure of sterile air in a manner known to those of ordinary skill in the pertinent art. In the illustrated embodiment, the housing 62 includes side walls formed by see-through panels in order to allow an operator to view the interior of the apparatus. If desired, however, the side walls could be opaque, or could include an arrangement of opaque and see-through portions different than that shown. As shown, one or more of the side panels may be mounted to the housing frame by hinges 61 in order to pivot the respective side panel outwardly to access the interior of the housing to, for example, perform maintenance and/or repairs. Otherwise, the side and top walls of the housing 62 are sealed with respect to the ambient atmosphere to maintain the sterility of the sterile zone 64.

The apparatus 58 includes on its inlet end an inlet transfer station 66 through which the conveyor 60 passes for transferring the containers 10 mounted on the conveyor 60 into the sterile zone 64. A sterilizing station 68 is located within the housing 62 immediately downstream of the inlet transfer station 66 in the direction of conveyor movement (clockwise in FIGS. 3A and 3B) and includes one or more sterilizing heads 70 coupled to a source of fluid sterilant (not shown) such as a hydrogen peroxide, vaporized hydrogen peroxide sterilant ("VHP") or other fluid sterilant that is currently or later known, for transmitting the fluid sterilant onto the exterior surfaces of the containers to sterilize the exterior surfaces. The apparatus 58 further includes within the housing 62 a first sterilant removing station 72 located downstream of the sterilizing station 68 in the direction of conveyor movement, and a second sterilant removing station 74 located downstream of the first sterilant removing station 72. Each sterilant removing station 72, 74 includes one or more respective sterilant flushing heads 76 for transmitting heated sterile air or other gas over the exterior surfaces of the containers at a sufficient temperature, flow rate and/or volume, and for a sufficient time period to substantially entirely remove the fluid sterilant therefrom. The vaporized peroxide may condense at least in part on the surfaces of the containers and/or conveyor, and therefore it is desirable to flush such surfaces with a heated, sterile air or other gas to re-vaporize any condensed hydrogen peroxide and flush it out of the sterile zone. In the currently preferred embodiment, the temperature of the sterile air is at least about 60° C.; however, as may be recognized by those of ordinary skill in the pertinent art based on the teachings herein, the temperature may be set as desired or otherwise required by a particular application. A needle filling station 78 is located within the housing 62 downstream of the second sterilant removing station 74 for needle filling each container 10 with product from a product fill tank 80, and first and second laser resealing stations 82 and 84, respectively, are located downstream of the needle filling station 78 for laser resealing the resulting needle holes formed in the stoppers of the containers after filling the containers and withdrawing the needles. An exit transfer station 86 is located downstream of the laser resealing stations 82, 84 for transferring the filled containers 10 on the conveyor 60 out of the sterile zone 64. After exiting the sterile zone 64, the containers 10 are capped with the caps or securing members 20 and ready for shipment.

The over pressure of sterile air or other gas is provided by a sterile gas source 88 including one or more suitable filters, such as HEPA filters, for sterilizing the air or other gas prior to introducing same into the sterile zone 64. A fluid conduit 90 is coupled in fluid communication between the sterile air source 88 and the sterile zone 64 for directing the sterile air into the sterile zone. The apparatus 58 includes one or more vacuum pumps or other vacuum sources (not shown) mounted within a base support 87 of the apparatus and of a type known to those of ordinary skill in the pertinent art. The vacuum source(s) are coupled in fluid communication with an exhaust manifold at the inlet transfer station 66 and an exhaust manifold at the exit transfer station 86 for drawing the air and fluid sterilant out of the sterile zone 64 and exhausting same through a catalytic converter 92 and exhaust conduit 94. The catalytic converter 92 is of a type known to those of ordinary skill in the pertinent art to break down the exhausted hydrogen peroxide into water and oxygen. In the illustrated embodiment, the exhaust manifolds are mounted at the base of the inlet and outlet stations and extend into the base support 87. As can be seen, the exhaust manifolds at the inlet and outlet stations 66 and 86, respectively, draw into the exhaust passageways located within the base support 87 (not shown) both sterile air and fluid sterilant from the sterile zone 64, and non-sterile ambient air located either within the inlet station or outlet station. As a result, any ambient non-sterile air (including any other ambient gases or contaminants) in the inlet and outlet stations are drawn into the exhaust manifolds, and thereby prevented from entering the sterile zone 64 to maintain the sterility of the sterile zone. Similarly, any sterile air or sterilant is substantially prevented from being re-circulated within the sterile zone, and instead, is drawn into the exhaust manifolds after passage over the containers and/or conveyor portion located within the sterile zone. If desired, one or more exhaust manifolds may be located at the base of the sterile zone (i.e., beneath the conveyor 60 or between the overlying and underlying portions of the conveyor 60) for fully exhausting the air and fluid sterilant and otherwise for avoiding the creation of any "dead" zones where air and/or fluid sterilant may undesirably collect. In one embodiment of the present invention, the flow of sterile air within the sterile zone 64 is controlled to cause the air to flow generally in the direction from right to left in FIG. 3A (i.e., in the direction from the needle filling station 78 toward the sterilizing station 68) to thereby prevent any fluid sterilant from flowing into the needle filling and laser resealing stations 78, 82 and 84. This flow pattern may be effected by creating a higher vacuum at the inlet station 66 in comparison to the outlet station 86. However, as may be recognized by those of ordinary skill in the pertinent art based on the teachings herein, this flow pattern or other desired flow patterns may be created within the sterile zone in any of numerous different ways that are currently known, or that later become known.

In the illustrated embodiment, the conveyor 60 includes a plurality of flights or like holding mechanisms 96 that clamp each container 10 at or below its neck finish (i.e., at the peripheral region immediately below the mouth or opening 16 of the body 12) or other desired container region. The flights 96 are pivotally mounted on a belt 98 defining a closed loop and rotatably mounted on rollers 100 located on opposite sides of the apparatus relative to each other. One or more drive motors and controls (not shown) may be mounted within the base support 87 and are coupled to one or both rollers 100 for rotatably driving the conveyor 60 and, in turn, controlling movement of the containers 10 through the apparatus in a manner known to those of ordinary skill in the pertinent art. Each flight 96 of the conveyor 60 includes a plurality of container-engaging recesses 102 laterally spaced relative to each other and configured for engaging the respective necks or other desired portions of the containers 10 to support the containers on the conveyor. Although the container-engaging recesses 102 are illustrated as being semi-circular in order to engage the containers 10, they equally may be formed in any of numerous different shapes that are currently known, or that later become known, in order to accommodate any desired container shape, or otherwise as desired. The flights 96 further define a plurality of vent apertures 104 that are laterally spaced relative to each other, and are formed between and adjacent to the container-engaging recesses 102. The vent apertures 104 are provided to allow the sterile air and fluid sterilant to flow over the portions of the containers 10 located above the flights 96 of the conveyor and, in turn, through the conveyor prior to being exhausted through the exhaust manifolds. In the illustrated embodiment, the vent apertures 104 are provided in the form of elongated slots; however, as may be recognized by those of ordinary skill in the pertinent art based on the teachings herein, the vent apertures may take any of numerous different configurations that are currently known, or that later become known. Preferably, the flights 96 laterally engage the neck portions of the containers 10, and effectively isolate the sterile portions of the containers above the flights from the portions of the containers located below the flights that may not be sterile, or that may include surface portions that are not sterile.

The conveyor 60 defines an inlet end 106 for receiving the containers 10 to be fed into the apparatus, and an outlet end 108 for removing the filled and laser resealed containers from the apparatus. As can be seen, the adjacent flights 96 located at the inlet and outlet ends 106 and 108, respectively, are pivoted relative to each other upon passage over the rollers 100 to thereby define a loading gap 110 at the inlet end of the conveyor and an unloading gap 112 at the outlet end of the conveyor. Accordingly, at the inlet end, the containers 10 may be fed on their sides into the loading gap 110 and received within the container-engaging recesses 102 of the respective flight 96. Then, as the conveyor 60 is rotated in the clockwise direction in FIGS. 3A and 3B, the opposing flights 96 are pivoted toward each other to thereby engage the containers 10 between the opposing recesses 102 of adjacent flights. Similarly, at the outlet end 108, the formation of the unloading gap 112 between the respective flights 96 allows the containers loaded thereon to be removed from the conveyor. Any of numerous different devices for automatically, semi-automatically, or manually loading and/or unloading the containers onto the conveyor that are currently known, or that later become known, may be employed. In addition, any of numerous different apparatus that are currently known, or that later become known, may be employed to cap the filled containers after exiting the sterile zone. As may be recognized by those of ordinary skill in the pertinent art based on the teachings herein, the conveyor, the devices for holding the containers onto the conveyor, and/or the apparatus for driving and/or controlling the conveyor may take any of numerous different configurations that are currently known, or that later become known.

In the illustrated embodiment, each flight 96 of the conveyor is configured to hold four containers 10 spaced laterally relative to each other. Accordingly, in the illustrated embodiment, each sterilizing head 70 located within the sterilizing station 70 includes two sterilant manifolds 114, and four sterilizing nozzles 116 mounted on each sterilant manifold. Each sterilizing nozzle 116 is located over a respective container position on the conveyor to direct fluid sterilant onto the respective container. Similarly, each sterilant flushing head 76 located within the sterilant removing stations 72 and 74 includes two flushing manifolds 118, and each flushing manifold 118 includes four flushing nozzles 120. Each flushing nozzle 120 is located over a respective container position on the conveyor to direct heated sterile air or other gas onto the respective container to re-vaporize if necessary and flush away the fluid sterilant. In the illustrated embodiment, the conveyor 60 is indexed by two rows of containers (or flights) at a time, such that at any one time, two rows of containers are each being sterilized, needle filled, and laser resealed within the respective stations, and four rows of containers are being flushed within the two sterilant removing stations (i.e., the first sterilant removing station 72 applies a first flush, and the second sterilant removing station 74 applies a second flush to the same containers). When each such cycle is completed, the conveyor is indexed forward (or clockwise in FIGS. 3A and 3B) a distance corresponding to two rows of containers, and the cycle is repeated. As may be recognized by those of ordinary skill in the pertinent art based on the teachings herein, the apparatus may define any desired number of stations, any desired number of container positions within each station, and if desired, any desired number of apparatus may be employed to achieve the desired throughput of containers.

The needle filling station 78 comprises a needle manifold 122 including a plurality of needles 124 spaced relative to each other and movable relative to the flights 96 on the conveyor 60 for penetrating a plurality of containers 10 mounted on the portion of the conveyor within the filling station, filling the containers through the needles, and withdrawing the needles from the filled containers. Each of the laser resealing stations 82 and 84 comprises a plurality of laser optic assemblies 126, and each laser optic assembly is located over a respective container position of the conveyor flights located within the respective laser resealing station. Each laser optic assembly is connectable to a source of laser radiation (not shown), and is focused substantially on a penetration spot on the second material portion 24 of the stopper 18 of the respective container 10 for applying laser radiation thereto and resealing the respective needle aperture. Also in the illustrated embodiment, each laser resealing station 82 and 84 further comprises a plurality of optical sensors (not shown). Each optical sensor is mounted adjacent to a respective laser optic assembly 126 and is focused substantially on the laser resealed region of a stopper 18 of the respective laser optic assembly, and generates signals indicative of the temperature of the laser resealed region to thereby test the integrity of the thermal seal.

In one embodiment of the present invention, a non-coring filling needle 124 defines dual channels (i.e., a double lumen needle), wherein one channel introduces the substance into the storage chamber 14 and the other channel withdraws the displaced air and/or other gas(es) from the storage chamber. In another embodiment, a first non-coring needle introduces the substance into the chamber and a second non-coring needle (preferably mounted on the same needle manifold for simultaneously piercing the stopper) is laterally spaced relative to the first needle and withdraws the displaced air and/or other gas(es) from the chamber. In another embodiment, grooves are formed in the outer surface of the needle to vent the displaced gas from the storage chamber. In one such embodiment, a cylindrical sleeve surrounds the grooves to prevent the septum material from filling or blocking the grooves (partially or otherwise) and thereby preventing the air and/or other gases within the container from venting therethrough. In each case, the channels or passageways may be coupled to a double head (or channel) peristaltic pump such that one passageway injects the product into the storage chamber, while the other passageway simultaneously withdraws the displaced air and/or other gases from the storage chamber. In some embodiments of the present invention, there is preferably a substantially zero pressure gradient between the interior of the filled storage chamber 14 and the ambient atmosphere. Also in some embodiments of the present invention, the substance substantially entirely fills the storage chamber (or is filled to a level spaced closely to, or substantially in contact with the interior surface of the first material portion 22, but not in contact with the exposed portion 26 of the second material portion 24).

Figure 1B:
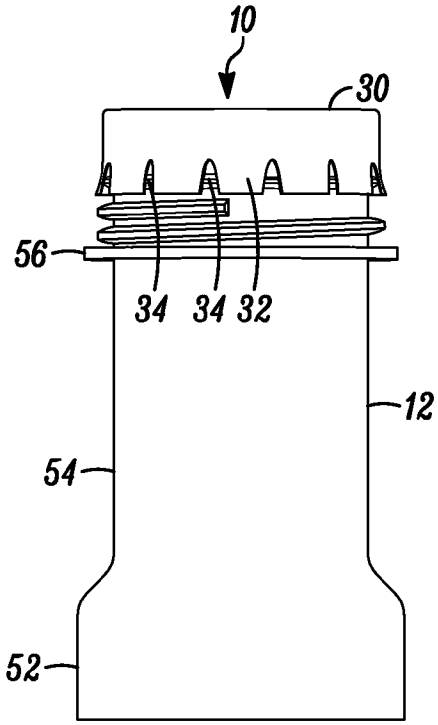
Figure 1A:
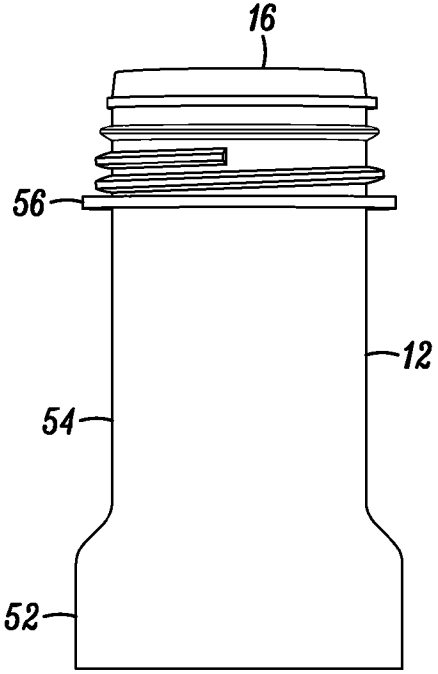

As shown typically in FIGS. 1A-1C, in one embodiment of the invention, the body 12 defines a base 52, a mid-portion 54, and an upper portion 56 axially spaced from the base on an opposite side of the mid-portion relative to the base, and each of the base and upper portion define a laterally-extending dimension greater than a maximum laterally-extending dimension of the mid-portion. As a result, as also shown typically in FIGS. 1A-1C, in the illustrated embodiment, the assembled container defines a substantially diabolo or spool shape. During needle filling and resealing, the container engaging recesses 102 of the flights 96 engage the mid-portion 54 of the body 12 immediately below the upper portion 56. Accordingly, the upper portion 56 of the body is engageable with the upper surface of the respective flight or other container support for substantially preventing axial movement of the body relative thereto during at least one of needle penetration and withdrawal with respect to the stopper, and the base 52 of the body 12 is engageable with the lower surface of the respective flight or other container support for substantially preventing axial movement of the body relative thereto during at least one of needle penetration and withdrawal with respect to the stopper.

In the illustrated embodiment of the present invention, the second material portion 24 is preferably made of a thermoplastic/elastomer blend, and may be the same material as those described in the co-pending patent applications and/or patents incorporated by reference above. Accordingly, in one such embodiment, the second material portion 24 is a thermoplastic elastomer that is heat resealable to hermetically seal the needle aperture by applying laser radiation at a predetermined wavelength and power thereto, and defines (i) a predetermined wall thickness, (ii) a predetermined color and opacity that substantially absorbs the laser radiation at the predetermined wavelength and substantially prevents the passage of the radiation through the predetermined wall thickness thereof, and (iii) a predetermined color and opacity that causes the laser radiation at the predetermined wavelength and power to hermetically seal the needle aperture formed in the needle penetration region thereof in a predetermined time period of less than or equal to about 5 seconds and substantially without burning the needle penetration region.

In one embodiment, the second material portion 24 is a thermoplastic elastomer that is heat resealable to hermetically seal the needle aperture by applying laser radiation at a predetermined wavelength and power thereto, and includes (i) a styrene block copolymer; (ii) an olefin; (iii) a predetermined amount of pigment that allows the second material portion to substantially absorb laser radiation at the predetermined wavelength and substantially prevent the passage of radiation through the predetermined wall thickness thereof, and hermetically seal the needle aperture formed in the needle penetration region thereof in a predetermined time period of less than or equal to about 5 seconds; and (iv) a predetermined amount of lubricant that reduces friction forces at an interface of the needle and second material portion during needle penetration thereof. In one such embodiment, the second material portion includes less than or equal to about 40% by weight styrene block copolymer, less than or equal to about 15% by weight olefin, less than or equal to about 60% by weight mineral oil, and less than or equal to about 3% by weight pigment and any processing additives of a type known to those of ordinary skill in the pertinent art.

In one embodiment, the second material portion 24 is a thermoplastic elastomer that is heat resealable to hermetically seal the needle aperture by applying laser radiation at a predetermined wavelength and power thereto, and includes (i) a first polymeric material in an amount within the range of about 80% to about 97% by weight and defining a first elongation; (ii) a second polymeric material in an amount within the range of about 3% to about 20% by weight and defining a second elongation that is less than the first elongation of the first polymeric material; (iii) a pigment in an amount that allows the second material portion to substantially absorb laser radiation at the predetermined wavelength and substantially prevent the passage of radiation through the predetermined wall thickness thereof, and hermetically seal a needle aperture formed in the needle penetration region thereof in a predetermined time period of less than or equal to about 5 seconds; and (iv) a lubricant in an amount that reduces friction forces at an interface of the needle and second material portion during needle penetration thereof.

In one embodiment of the invention, the pigment is sold under the brand name Lumogen™ IR 788 by BASF Aktiengesellschaft of Ludwigshafen, Germany. The Lumogen IR products are highly transparent selective near infrared absorbers designed for absorption of radiation from semiconductor lasers with wavelengths near about 800 nm. In this embodiment, the Lumogen pigment is added to the elastomeric blend in an amount sufficient to convert the radiation to heat, and melt the stopper material, preferably to a depth equal to at least about ⅓ to about ½ of the depth of the needle hole, within a time period of less than or equal to about 5 seconds, preferably less than about 3 seconds, and most preferably less than about 1½ seconds. The Lumogen IR 788 pigment is highly absorbent at about 788 nm, and therefore in connection with this embodiment, the laser preferably transmits radiation at about 788 nm (or about 800 nm). One advantage of the Lumogen IR 788 pigment is that very small amounts of this pigment can be added to the elastomeric blend to achieve laser resealing within the time periods and at the resealing depths required or otherwise desired, and therefore, if desired, the needle penetrable and laser resealable stopper may be transparent or substantially transparent. This may be a significant aesthetic advantage. In one embodiment of the invention, the Lumogen IR 788 pigment is added to the elastomeric blend in a concentration of less than about 150 ppm, is preferably within the range of about 10 ppm to about 100 ppm, and most preferably is within the range of about 20 ppm to about 80 ppm. In this embodiment, the power level of the 800 nm laser is preferably less than about 30 Watts, or within the range of about 8 Watts to about 18 Watts.

In one embodiment of the present invention, the substance or product contained within the storage chamber is a fat containing liquid product, such as infant or baby formula, and the first material portion 22, the second material portion 24, and the body 12 each are selected from materials (i) that are regulatory approved for use in connection with nutritional foods, and preferably are regulatory approved at least for indirect contact, and preferably for direct contact with nutritional foods, (ii) that do not leach an undesirable level of contaminants or non-regulatory approved leachables into the fat containing product, such mineral oil, and (iii) that do not undesirably alter the taste profile (including no undesirable aroma impact) of the fat containing liquid product to be stored in the container. In certain embodiments of the invention, the needle penetrable and thermally resealable second material portion 24 provides lesser or reduced barrier properties in comparison to the first material portion, and therefore the first material portion 22 and/or over cap 20 are selected to provide the requisite barrier properties of the container closure 15 for purposes of storing the product to be contained therein.

In the embodiment of the present invention wherein the product is a fat containing liquid nutrition product, such as an infant or baby formula, exemplary materials for the second material portion 24 are selected from the group including GLS 254-071, C-Flex R70-001, Evoprene TS 2525 4213, Evoprene SG 948 4213 and Cawiton 7193, modifications of any of the foregoing, or similar thermoplastic elastomers. In one such embodiment, the body 12 is an injection molded multi-layer of PP/EVOH. In another such embodiment, the body 12 is blow molded, such as by extrusion blow molding, and is an HDPE/EVOH multi layer. In some such embodiments, the first material portion 22 is selected from the group including (i) a low mineral oil or mineral oil free thermoplastic; (ii) a low mineral oil or mineral oil free thermoplastic defining a predetermined durometer; (iii) a liquid injection moldable silicone; and (iv) a silicone. The predetermined durometer is within the range of about 20 Shore A to about 50 Shore A, and preferably is within the range of about 25 Shore A to about 35 Shore A. In some such embodiments, the first material portion is formed of polyethylene, an HDPE/TPE blend or multi layer, or a PP/TPE blend or multi layer. Also in some such embodiments, the securing member or cap 20 is made of a plastic sold under the trademark Celcon™, a PP/EVOH multi layer, an HDPE/EVOH multi layer or blend, or a HDPE/EVOH multi layer or blend. As may be recognized by those or ordinary skill in the pertinent art based on the teachings herein, these materials are only exemplary, and numerous other materials that are currently known, or that later become known, equally may be used.

Figure 4:
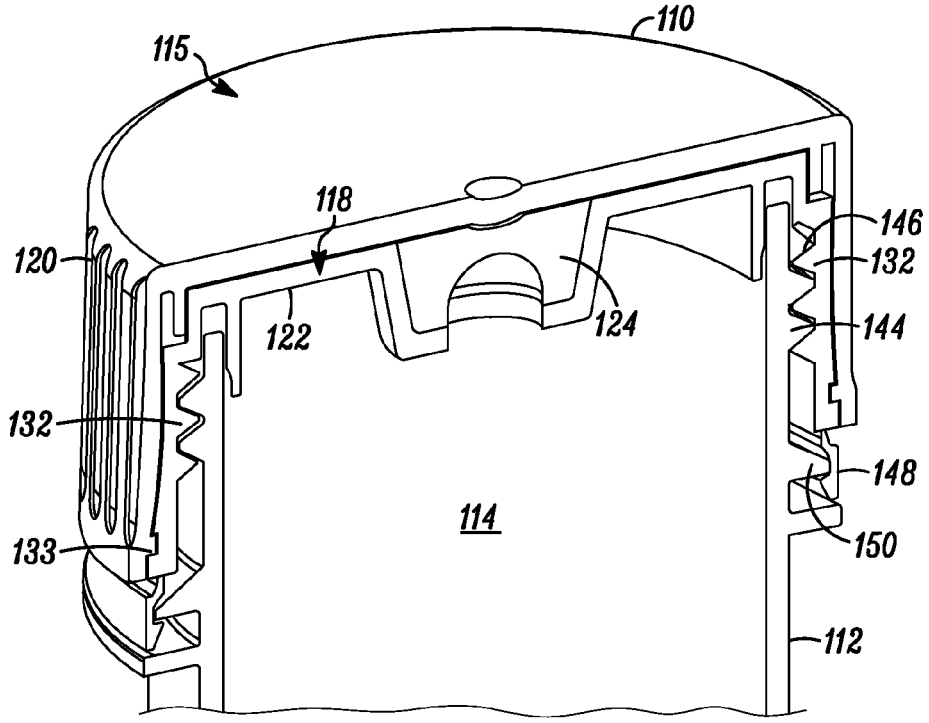
FIG. 4 is a partial, perspective cross-sectional view of another embodiment of a container of the present invention wherein the stopper is threadedly engaged with the body, and the cap is snap fit to the stopper.

In FIG. 4, another container embodying the present invention is indicated generally by the reference number 110. The container 110 is substantially similar to the container 10 described above, and therefore like numbers preceded by the number "1" are used to indicate like elements. The primary difference of the container 110 in comparison to the container 10 is that the first material portion 122 of the stopper 118 includes a peripheral flange 132 defining internal female threads 146 that threadedly engage male threads 144 on the body 112 to threadedly secure the stopper to the body. In this embodiment, the seal between the stopper and body can be formed in any of numerous different ways that are currently known, or that later become known, including, for example, by a "plug" seal, a "valve" seal, or a "direct" seal between the top edge of the body and a gasket formed on the stopper. In the latter case, the gasket can be formed by the second material portion 124 at the time of co-molding the first and second material portions 122 and 124, respectively, or at the time of over-molding the second material portion 124 to the first material portion 122. In this embodiment, the cap 120 does not secure the closure 115 to the body 112, but rather is snap fit at 133 to the depending flange 132 of the first material portion 122 and provides the requisite barrier properties for the container closure (i.e., an oxygen and moisture-vapor transmission ("MVT") barrier). In the illustrated embodiment, as can be seen, the snap fit connection 133 is formed by an annular protuberance on the cover 120 received within a corresponding annular groove on the flange 132. However, as may be recognized by those of ordinary skill in the pertinent art based on the teachings herein, the cap 120 may be fixedly secured to the stopper 118 in any of numerous different ways that are currently known, or that later become known. Also in this embodiment, a frangible tamper evident ring 148 is formed at the base of the depending flange 132 of the first material portion 122 of the stopper 118 and slides over a tamper evident ridge 150 of the body 112 to releasably engage the tamper evident ring and cap to the body.

Figure 5:
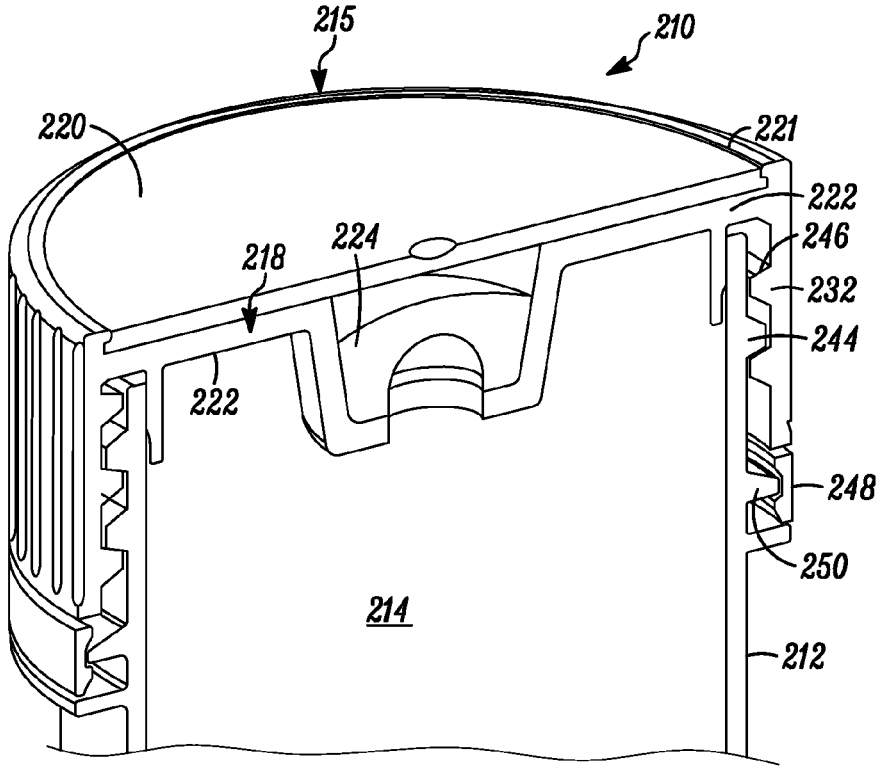
FIG. 5 is a partial, perspective cross-sectional view of another embodiment of a container of the present invention wherein the securing member is in the form of a disk overlying the stopper and fixedly secured thereto.

In FIG. 5, another container embodying the present invention is indicated generally by the reference number 210. The container 210 is substantially similar to the container 110 described above, and therefore like reference numerals preceded by the numeral "2" instead of the numeral "1" are used to indicate the same or similar elements. The primary difference of the container 210 in comparison to the container 110 described above is that the container 210 does not include a conventional cap, but rather includes a barrier disk 220 that is received within a recess 221 formed in the upper surface of the first material portion 222 of the stopper 218. As can be seen, the barrier disk 220 overlies the container closure 215 and forms a seal between the first material portion 224 and the ambient atmosphere to thereby provide the requisite barrier properties between the storage chamber 214 and ambient atmosphere. In the illustrated embodiment, the barrier disk 220 is fixedly secured to the first material portion 222 of the stopper 218 such as by ultrasonic or induction welding or sealing. However, as may be recognized by those of ordinary skill in the pertinent art based on the teachings herein, the barrier disk can be fixedly secured to the stopper in any of numerous different ways that are currently known, or that later become known. As with the caps of the embodiments described above, the barrier disk 220 is assembled to the stopper 218 after needle filling and laser resealing the stopper, and preferably outside of the sterile filling zone.

As may be recognized by those skilled in the pertinent art based on the teachings herein, numerous changes and modifications may be made to the above-described and other embodiments of the present invention without departing from its scope as defined in the appended claims. For example, the first and second material portions, body and cap may be made of any of numerous different materials that are currently known, or that later become known for performing their functions and/or depending on the container application(s), including the product to be stored within the container. In addition, the body and container closure may take any of numerous different shapes and/or configurations, and may be adapted to receive and store within the storage chamber any of numerous different substances or products that are currently known or that later become known, including without limitation, any of numerous different food and beverage products, including low acid or fat containing liquid products, such as milk-based products, including without limitation milk, evaporated milk, infant formula, growing-up milks, condensed milk, cream, half-and-half, yogurt, and ice cream (including dairy and non-diary, such as soy-based ice cream), other liquid nutrition products, liquid healthcare products, juice, syrup, coffee, condiments, such as ketchup, mustard, and mayonnaise, and soup, and pharmaceutical products. Accordingly, this detailed description of preferred embodiments is to be taken in an illustrative, as opposed to a limiting sense.

What is claimed is:

1. A method for aseptically filling and resealing at least one container with a liquid product, each container including a body defining an empty, sealed storage chamber therein for receiving the liquid product, and a needle penetrable and resealable portion defining a closure for the container, the method of filling each of the at least one container comprising the following steps:

mounting the sealed, empty container on a conveyor, and moving the conveyor through a sterile zone;

transmitting within the sterile zone a fluid sterilant onto at least a portion of the container and, in turn, sterilizing with the fluid sterilant at least the portion of the container;

removing the fluid sterilant from the portion of the container via at least one vacuum source configured and adapted to remove the fluid sterilant from the portion of the container;

introducing liquid product through a filling needle penetrating through the resealable portion;

withdrawing the filling needle from the resealable portion; and resealing a resulting needle aperture in the resealable portion to reseal the resealable portion and, in turn, hermetically seal the liquid product within the storage chamber.

2. A method as defined in claim 1, further comprising the step of penetrating the resealable portion with the filling needle, thereby forming said needle aperture.

3. A method as defined in claim 1, wherein the step of transmitting fluid sterilant includes transmitting sterilant onto an external portion of the resealable portion.

4. A method as defined in claim 1, further comprising the step of removing the fluid sterilant from the portion of the container.

5. A method as defined in claim 1, wherein the step of moving the conveyor though the sterile zone comprises moving the conveyor between an inlet end and an outlet end of a housing in a direction from the inlet end toward the outlet end; and the step of transmitting fluid sterilant comprises transmitting fluid sterilant at a fluid sterilant station within the sterile zone.

6. A method as defined in claim 1, wherein the storage chamber is a sterile storage chamber.

7. A method as defined in claim 1, wherein the at least one container comprises a plurality of containers, liquid product is introduced into the containers through a plurality of needles spaced relative to each other and movable relative to the containers for penetrating a respective resealable portion of each container, and a plurality of radiation assemblies perform the resealing step by applying radiation to a plurality of resultant needle apertures to hermetically seal the liquid product in the containers.

8. A method as defined in claim 7, wherein the plurality of radiation assemblies comprise a plurality of laser optic assemblies, and the step of applying radiation comprises focusing the plurality of laser optic assemblies substantially on said needle apertures, applying laser radiation from the laser optic assemblies thereto, and, in turn, thermally resealing the needle apertures.

9. A method as defined in claim 1, wherein the fluid sterilant is hydrogen peroxide.

10. A method as defined in claim 1, wherein the resealing step comprises applying radiation to the needle aperture to reseal the resealable portion.

11. A method as defined in claim 1, wherein the resealing step comprises hermetically resealing the needle aperture by covering the needle aperture with a cover having barrier properties sufficient to form a seal between the needle aperture and the ambient atmosphere and thereby hermetically reseal the needle aperture.

12. A method as defined in claim 10, wherein the step of applying radiation comprises applying laser radiation to thermally reseal the resealable portion to hermetically seal the liquid product within the storage chamber.

13. An assembly comprising:

a container including a body defining an empty, sealed storage chamber therein for receiving liquid product, and a needle penetrable and resealable portion defining a closure for the container;

a conveyor located at least partially within a sterile zone and defining a plurality of container positions thereon for supporting and moving containers in a direction through the sterile zone;

at least one fluid sterilant station located within the sterile zone and coupled in fluid communication with a source of fluid sterilant for transmitting fluid sterilant onto at least a portion of the container on the conveyor within the at least one fluid sterilant station and sterilizing at least the portion of the container;

at least one vacuum source configured and adapted to remove the fluid sterilant from the portion of the container;

a filling apparatus comprising a needle manifold including a plurality of needles spaced relative to each other and movable relative to the conveyor for penetrating a plurality of containers on the conveyor within the filling apparatus, filling the containers through the needles, and withdrawing the needles from the filled containers; and a plurality of assemblies adapted to reseal a resultant needle aperture in the resealable portion, and in turn, hermetically sealing the liquid product within the storage chamber.

14. An assembly as defined in claim 13, wherein the fluid sterilant is hydrogen peroxide.

15. An assembly as defined in claim 13, wherein the at least one fluid sterilant station is configured and adapted to transmit fluid sterilant onto at least an external portion of the penetrable and resealable portion.

16. An assembly as defined in claim 13, further comprising a housing defining an inlet end, an outlet end, wherein the sterile zone is located between the inlet and outlet ends, the conveyor moves in a direction from the inlet end to the outlet end, and the needle manifold and assemblies are located within the sterile zone between the at least one fluid sterilant station and the outlet end of the housing for receiving the sterilized containers therefrom.

17. An assembly as defined in claim 13, wherein said assemblies comprise laser optic assemblies connectable to a source of laser radiation for applying laser radiation to the resealable portion and thermally resealing the needle aperture and hermetically resealing the liquid product within the storage chamber.

18. As assembly as defined in claim 13, wherein the storage chamber is a sterile storage chamber.

19. An assembly as defined in claim 13, wherein said assemblies are connectable to a source of radiation for applying radiation to the resealable portion and resealing the needle aperture.

20. An assembly as defined in claim 13, wherein said assemblies are adapted to hermetically reseal the needle aperture by covering the needle aperture with a cover having barrier properties sufficient to form a seal between the needle aperture and the ambient atmosphere and thereby hermetically reseal the needle aperture.

21. A method for aseptically filling and resealing at least one container with a liquid product, each container including a body defining an empty, sealed storage chamber therein for receiving the liquid product, and a needle penetrable and resealable portion defining a closure for the container, the method of filling each of the at least one container comprising the following steps:

mounting the sealed, empty container on a conveyor;

transmitting a fluid sterilant onto at least a portion of the container and, in turn, sterilizing with the fluid sterilant at least the portion of the container;

removing the at least one fluid sterilant from the portion of the container via at least one vacuum source configured and adapted to remove the at least one fluid sterilant from the portion of the container;

introducing liquid product through a filling needle penetrating through the resealable portion;

withdrawing the filling needle from the resealable portion; and resealing a resulting needle aperture in the resealable portion to reseal the resealable portion and, in turn, hermetically seal the liquid product within the storage chamber.

22. An assembly, comprising:

a container including a body defining an empty, sealed storage chamber therein for receiving liquid product, and a needle penetrable and resealable portion defining a closure for the container;

a conveyor defining a plurality of container positions thereon for supporting and moving containers;

at least one fluid sterilant station coupled in fluid communication with a source of fluid sterilant for transmitting fluid sterilant onto at least a portion of the container on the conveyor within the at least one fluid sterilant station and sterilizing at least the portion of the container;

at least one vacuum source configured and adapted to remove the at least one fluid sterilant from the portion of the container;

a filling apparatus comprising a needle manifold including a plurality of needles spaced relative to each other and movable relative to the conveyor for penetrating a plurality of containers on the conveyor within the filling apparatus, filling the containers through the needles, and withdrawing the needles from the filled containers; and a plurality of assemblies adapted to reseal a resultant needle aperture in the resealable portion, and in turn, hermetically sealing the liquid product within the storage chamber.

23. A method for aseptically filling and resealing at least one container with a liquid product, each container including a body defining an empty, sealed storage chamber therein for receiving the liquid product, and a needle penetrable and resealable portion defining a closure for the container, the method of filling each of the at least one container comprising the following steps:

mounting the sealed, empty container on a conveyor, and moving the conveyor through a sterile zone;

transmitting within the sterile zone a fluid sterilant onto at least a portion of the container and, in turn, sterilizing with the fluid sterilant at least the portion of the container;

introducing liquid product through a filling needle penetrating through the resealable portion;

withdrawing the filling needle from the resealable portion; and resealing a resulting needle aperture in the resealable portion to reseal the resealable portion and, in turn, hermetically seal the liquid product within the storage chamber;

wherein the resealing step comprises hermetically resealing the needle aperture by covering the needle aperture with a cover having barrier properties sufficient to form a seal between the needle aperture and the ambient atmosphere and thereby hermetically reseal the needle aperture.

24. An assembly comprising:

a container including a body defining an empty, sealed storage chamber therein for receiving liquid product, and a needle penetrable and resealable portion defining a closure for the container;

a conveyor located at least partially within a sterile zone and defining a plurality of container positions thereon for supporting and moving containers in a direction through the sterile zone;

at least one fluid sterilant station located within the sterile zone and coupled in fluid communication with a source of fluid sterilant for transmitting fluid sterilant onto at least a portion of the container on the conveyor within the at least one fluid sterilant station and sterilizing at least the portion of the container;

a filling apparatus comprising a needle manifold including a plurality of needles spaced relative to each other and movable relative to the conveyor for penetrating a plurality of containers on the conveyor within the filling apparatus, filling the containers through the needles, and withdrawing the needles from the filled containers; and a plurality of assemblies adapted to reseal a resultant needle aperture in the resealable portion, and in turn, hermetically sealing the liquid product within the storage chamber;

wherein said assemblies are adapted to hermetically reseal the needle aperture by covering the needle aperture with a cover having barrier properties sufficient to form a seal between the needle aperture and the ambient atmosphere and thereby hermetically reseal the needle aperture.

* * * * *